US006341691B1

(12) United States Patent
Voss

(10) Patent No.: US 6,341,691 B1
(45) Date of Patent: Jan. 29, 2002

(54) PACKAGE FOR A STRIP-SHAPED OR BAND-SHAPED PRODUCT

(75) Inventor: Klaus-Wilhelm Voss, Uetersen (DE)

(73) Assignee: Vosschemie GmbH, Uetersen (DE)

( * ) Notice: Subject to any disclaimer, the term of this patent is extended or adjusted under 35 U.S.C. 154(b) by 0 days.

(21) Appl. No.: 09/564,333

(22) Filed: May 3, 2000

(30) Foreign Application Priority Data

Feb. 8, 2000 (DE) ..... 200 02 151 U

(51) Int. Cl.[7] ..... B65D 85/04
(52) U.S. Cl. ..... 206/397; 206/409; 242/170
(58) Field of Search ..... 206/389, 395–397, 206/408, 409, 415; 242/159, 160.1–160.4, 170, 171, 345, 348.3, 588.3, 588.6

(56) References Cited

U.S. PATENT DOCUMENTS 1,260,491 A * 3/1918 Weaver ..... 206/415
1,664,730 A * 4/1928 Beidler ..... 242/345
2,794,546 A * 6/1957 Miller ..... 206/397
3,184,053 A * 5/1965 Eldridge ..... 242/588.6
4,444,313 A * 4/1984 Tyson ..... 206/397
4,451,010 A * 5/1984 Meyer ..... 242/588.3
5,261,623 A * 11/1993 Dominesey et al. ..... 242/348.3
5,314,134 A * 5/1994 Harris et al. ..... 242/588.6
5,484,082 A * 1/1996 Casper et al. ..... 206/395
6,003,667 A * 12/1999 Barnett et al. ..... 206/396

* cited by examiner

*Primary Examiner*—Jim Foster
(74) *Attorney, Agent, or Firm*—Friedrich Kueffner

(57) ABSTRACT

For a better handling of strip-shaped or band-shaped products made of plastic, paper or foam plastic in roll form, a package (100) with a removal opening for the product provided in one of the package walls comprises a cubical or a right parallelepiped package body (10) made of cardboard or of another appropriate material with a hollow cylindrical holding device (30) made of paperboard, cardboard or another appropriate material, placed in the inner space (19) of the package body (10) and on two opposite side walls (13, 14) of the package body (10), for receiving the rolled-up product (20), whereby the hollow cylindrical holding device (30) is held by means of two stoppers (40, 40') stuck through openings or dowel holes (60) in the opposing side walls (13; 14) of the package body (10) constituting the pivot bearings for the hollow cylindrical holding device (30), whereby both pivot bearing stoppers (40; 40') can be locked on the side walls (13; 14) of the package body (10).

6 Claims, 1 Drawing Sheet

PACKAGE FOR A STRIP-SHAPED OR BAND-SHAPED PRODUCT

The invention relates to a package for a strip-shaped or band-shaped product made of plastic, paper or plastic foam, in roll form, an opening being provided in one of the package walls for removing the product.

BACKGROUND OF THE INVENTION

In the field of use of foils, bands, strips of paper, plastic or plastic foam materials, there are many package possibilities. These products are often wound up into rolls during the production and are packed as easy to use as possible for the consumer.

The aim of this invention is to improve the handling of such strip-shaped or band-shaped products so that a pulling off of these products from the roll which is appropriate for the handling is possible in order to pull off and separate a section thereof. Here, the product is to be packed in roll form in a package, i.e. in an enveloping carton, and to be stored loose in this carton without the product in roll form jamming or becoming distorted when being pulled off. Furthermore, the fixing and the bearing of the product roll is to be effected at low costs and the bearing of the product roll in the package without additional holding devices being necessary in the inner space of the package.

SUMMARY OF THE INVENTION

This aim is achieved for a package according to the type described above by the characteristics indicated in claim 1.

Accordingly, the package according to the invention comprises a cubical or a right parallelepiped package body made of cardboard or of another appropriate material with a hollow cylindrical holding device made of paperboard, cardboard or another appropriate material, placed in the inner space of the package body and on two opposite walls of the package body, for receiving the product roll, whereby the hollow cylindrical holding device is held by means of two stoppers stuck through openings or dowel holes in the walls of the package body constituting the pivot bearings for the hollow cylindrical holding device for the roll product, whereby both pivot bearing stoppers can be locked in the walls of the package body.

Accordingly, the holding device for the product roll, preferably a cardboard roll, is in the center of the package body, the bearing being such that this cardboard roll is held in the package body, i.e in the enveloping carton, as easily as possible at the lowest possible costs. In order to fix this holding device quickly and simply on the package body wall, the package body is constructed in such a way that it has an opening on both sides through which a stopper with a collar is stuck through the opening from outside because this pivot bearing stopper is fixed through a rotation on the package wall. To this end, the package body additionally has at least one punched out recess adjacent to the circular opening through which a locking pin or a trunnion, which is on the pivot bearing stopper, is introduced. This locking pin or this trunnion is placed at a distance from the collar of the pivot bearing stopper which approximately corresponds to the thickness of the package body material so that the locking pin or the trunnion conforms to the inner side of the package body wall on the back side thereof on its inner side by a rotation of the pivot bearing stopper, and thus a falling out of the pivot bearing stopper is prevented. Thus, the cylindrical holding device or the cardboard roll on which the product is rolled on is safely held rotating.

Such a constituted package for a rolled-up strip-shaped or band-shaped product can be produced economically and, due to the use of pivot bearing stoppers lockable in the wall faces of the package body of the package for the cylindrical hollow body or the cardboard roll, it is ensured that the product rolled up on the cardboard roll can easily be pulled off in order to be able to cut off sections. The locking of the hollow cylindrical holding device for the product by means of pivot bearing stoppers is easy to construct, can be produced without difficulty and enables the easy replacement of an empty hollow cylindrical holding device by a hollow cylindrical holding device with a new rolled-up product. Since the locking of the pivot bearing stoppers takes place only over a pin provided on the pivot bearing stopper which grasps behind the wall of the package in the area of an opening into which the pivot bearing stopper for the hollow cylindrical holding device or cardboard roll is stuck, it is ensured that on the one hand the pivot bearing stoppers are surely held on the walls of the package and, on the other hand, the pivot bearing stoppers can easily be pulled off from the walls of the package in order to replace the hollow cylindrical holding device or the cardboard roll.

Advantageous configurations of the invention are subject of the subclaims.

According to a further embodiment of the invention, two locking pins or trunnions are provided on the outer wall of the stopper body of each pivot bearing stopper on two opposite sides, two opposite slit-shaped or groove-shaped recesses being configured in the area of the edge limiting the opening in the wall of the package body for introducing the locking pins.

The diameter of each circular opening in the walls of the package body approximately corresponds to the outer diameter of the hollow cylindrical stopper body.

The hollow cylindrical stopper body is preferably configured closed at its free end in order to guarantee a sufficient inherent stability.

The ring-shaped disk or collar on the stopper body of the pivot bearing stoppers shows a self-adhesive foil to be sticked on from outside which projects over the outer edge of the ringshaped disk or collar and which is sticked to the outer wall surface of the wall of the package body which receives the pivot bearing stopper.

BRIEF DESCRIPTION OF THE DRAWINGS

An embodiment of the invention is represented in the drawing.

DETAILED DESCRIPTION OF THE PREFERRED EMBODIMENT

Figure 1:
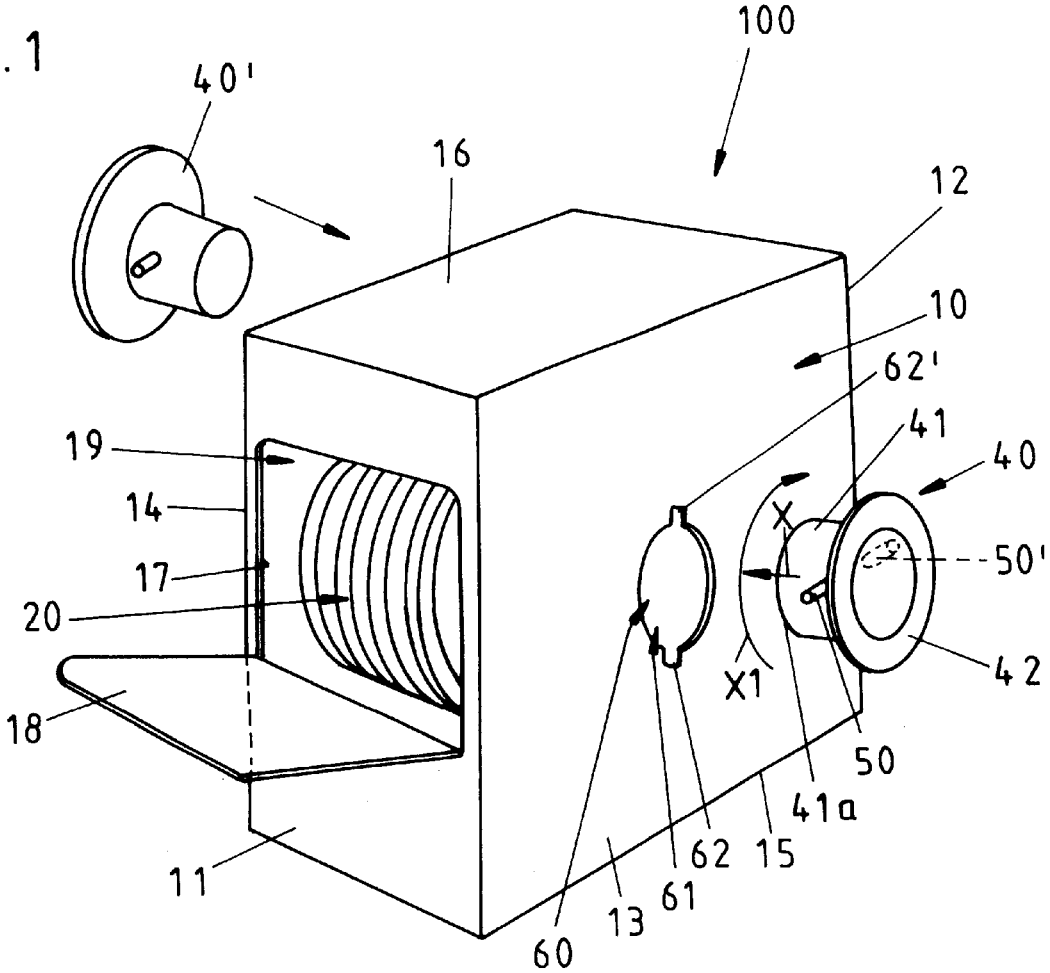
FIG. 1 is a graphical view of a package with a hollow cylindrical holding device placed in its inner space for a rolled-up strip-shaped or band-shaped product, the cylindrical holding device for the rolled-up product being held by means of pivot bearings stoppers on two opposite walls of the package body.

According to FIG. 1, the package configured according to the invention 100 for a strip-shaped or a band-shaped product 20 is made of a package body 10 with a front wall 11, a back wall 12, the two opposite side walls 13, 14, a bottom side wall 15 and a top side wall 16, a removal opening 16 for the product being configured in the front wall 11 which can be opened and closed by means of a closing bracket 18. A hollow cylindrical holding device 30 is held in the inner space 19 of the package body 10 by means of two pivot bearing stoppers 40, 40'. The product 20 is rolled up onto this hollow cylindrical holding device 30. The package body 10 of the package 100 which shows a cubical or a right parallelepiped or another appropriate geometrical form is made of cardboard or of another appropriate material and thus constitutes the enveloping carton for the rolled-up product. The hollow cylindrical holding device 30 for receiving the product 20 is made of paperboard, cardboard, plastic or another appropriate material. The pivot bearing stoppers 40, 40' are also configured in the same way. They are also made of paperboard, cardboard, plastic or another appropriate material.

The arrangement of the hollow cylindrical holding device 30 in the inner space 19 of the package body of the package 100 is made by means of the pivot bearing stoppers 40, 40'. Each pivot bearing stopper 40, 40' is made of a stopper body 41 which is preferably configured as a hollow cylinder and the free end 41 of which is closed by a sealing plate 43. This stopper body 41 carries at its other end a ring-shaped disk or a collar 42, the outer diameter of which is bigger than the outer diameter of the stopper body 41 itself. Moreover, the stopper body 41 of each pivot bearing stoper 40, 40' carries at least one locking,pin or trunnion 50. In the embodiment shown in FIG. 1 and 2, two locking pins or trunnions 50, 50' which are placed opposite are fixed to the stopper body 41. The distance between these locking pins or trunnions 50, 50' and the ring-shaped disk or collar 42 of the stopper body 41 approximately corresponds to the thickness of the material of which the package body 10 is made.

The pivot bearing stoppers 40, 40' are held in openings 60 of the two opposite side walls 13, 14. In FIG. 1, only the opening 60 for one of the one pivot bearing stopper 40 in the side wall 13 of the package body 10 is represented. In the same way, the other side wall 14 also shows an opening 60 configured correspondingly.

The diameter of the circular openings 60 approximately corresponds to the diameter of the hollow cylindrical stopper body 41 of the pivot bearing stoppers 40, 40" so that the pivot bearing stoppers can be stuck through these openings 60 in these side walls 13, 14 of the package body 10 so that the ring-shaped disks or collars 42 of the stopper body 41 of the two pivot bearing stoppers 40, 40' sit close to the outer wall faces of the side walls 13, 14.

Each opening 60 for the pivot bearing stopper 40 or 40' has slits or groove-shaped recesses 62, 62' for introducing the locking pins or trunnions 50, 50', these recesses being placed opposite as represented in FIG. 1. The size of these slits or groove-shaped recesses 62, 62' approximately corresponds to the length and to the thickness of the locking pins or trunnions 50, 50'. These slits or groove-shaped recesses 62, 62' are formed opposite in the area of the edges 61 limiting the openings 60 in the side walls 13, 14 of the package body. It is also possible to provide, for only an unique locking pin or trunnion on the stopper bodies 41 of the pivot bearing stoppers 40, 40'. The opening 60 for the pivot bearing stopper then shows only one slit or groove-shaped recess.

Figure 2:
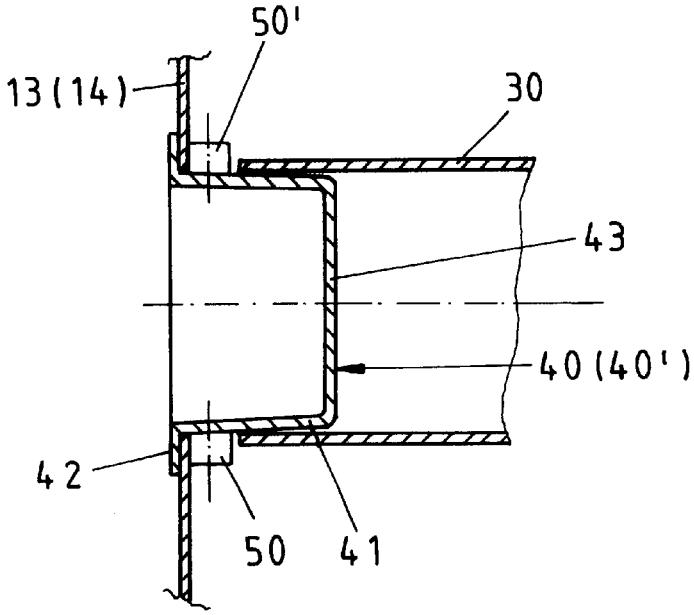
FIG. 2 shows a vertical section of a wall section of the package body with an inserted pivot bearing stopper for receiving a hollow cylindrical holding device for the rolled-up product.

For holding the hollow cylindrical holding device 30 with the rolled-up product in the inner space 19 of the package body 10 of the package 100, the pivot bearing stoppers 40, 40' are stuck into the openings in the side walls 13, 14 so that their locking pins or trunnions 50, 50' can also be stuck through the slits or groove-shaped recesses 62, 62' on the openings 60. When the ring-shaped disks or collars 42 on the stopper bodies 41 of the two pivot bearing stoppers 40, 40' are moved to take their bearing onto the outer wall faces of the side walls 13, 14, after having inserted the pivot bearing stoppers in direction of the arrow X, a torsion of the pivot bearing stoppers in direction of the arrow X1 takes place to the point that, due to the rotation, the pivot bearing stoppers 40, 40' are fixed on the side walls 13, 14 of the package body 10 (FIG. 2). Since the distance between the locking pins or the trunnions 50, 50' and the ring-shaped disks or collars 42 of the stopper body 41 corresponds to the material thickness of the package body 10 or of the side walls 13, 14, both pivot bearing stoppers 40, 40' are fixed in their position so that the hollow cylindrical holding device or the cardboard roll which is stuck onto the stopper bodies 41 of both pivot bearing stoppers 40, 40' is held on the pivot bearing stopper 40, 40' in such a manner that this hollow cylindrical holding device 30 cannot chafe laterally on the side walls 13, 14 of the package body and stick because of the adhesive when the strip-shaped or band-shaped product 20 rolled up on the hollow cylindrical holding device 30 is, for example, a self-adhesive foam plastic strip. Due to this constructional configuration, a distance piece of the hollow cylindrical holding device 30 with the rolled up product 20 to the side walls 13, 14 is achieved.

The ring-shaped disk or collar 42 of the stopper body 41 of each pivot bearing stopper 40, 40' can additionally be provided with a foil to be sticked from outside which projects over the edge of the ring-shaped disk or collar 42 and which is sticked with the projecting section to the outer wall face of the side wall 13 or 14 of the package body 10 so that it prevents the pivot bearing stopper 40, 40' from a further rotation movement.

What is claimed is:

1. A package for a strip-shaped or band-shaped product made of plastic, paper or plastic foam, in roll form, an opening being provided in one of the package walls for removing the product, wherein the package (100) comprises a cubicle or a right parallelepipedal package body (10) made of cardboard with a hollow cylindrical holding device made of paperboard or cardboard, placed in the inner space (19) of the package body (10) and on two opposite side walls (13, 14) of the package body (10), for receiving the product roll (20), whereby the hollow cylindrical holding device (30) is held by means of two stoppers (40, 40') stuck through openings or dowel holes (60) in the opposing side walls (13; 14) of the package body (10) constituting the pivot bearings for the hollow cylindrical holding device (30) and that both pivot bearing stoppers (40; 40') can be locked on the side walls (13; 14) of the package body (10), wherein each pivot bearing stopper (40; 40') is made of a hollow cylindrical stopper body (41) made of paperboard or cardboard with a ring-shaped disk or collar (42) configured at one end with a bigger diameter than the outer diameter of the hollow cylindrical stopper body (41), that at least one locking pin or trunnion (50; 50') is provided on the outer wall of the stopper body (41) of each pivot bearing stopper (40; 40') and that the opening (60) in the side walls (13; 14) of the packing body (10) has an edge (61) limiting the opening (60), wherein the edge (61) has a number of slit-shaped or groove-shaped radial recesses (62; 62') corresponding to the number of locking pins or trunnions (50; 50'), wherein the locking pins or trunnions (50; 50') are pushed into the inner space (19) through the radial recesses (62; 60) by inserting the pivot bearing stoppers (40; 40') into the openings (60) in the side walls (13; 14)), and the pivot bearing stoppers (40; 40') are locked in the openings (60) by rotating the locking pins or trunnions (50, 50') away from the radial recesses (62; 60).

2. A package according to claim 1, wherein two locking pins or trunnions (50; 50') are provided on the outer wall of the stopper body (41) of each pivot bearing topper (40; 40') on two opposite sides and that two opposite slit-shaped or groove-shaped recesses (62; 62') are configured in the area of the edge (61) limiting the opening (60) in the side wall (13, 14) of the package body (10) for introducing the locking pins or trunnions (50; 50') by inserting the pivot bearing stoppers (40; 40') into the openings (60) in the side walls (13; 14) of the package body (10).

3. A package according to claims 1, wherein the diameter of each circular opening (60) in the side walls (13, 14) of the package body (10) approximately corresponds to the outer diameter of the hollow cylindrical stopper body (41) of the pivot bearing stoppers (40; 40').

4. A package according to claim 1, wherein the hollow cylindrical stopper body (41) of each pivot bearing stopper (40; 40') is configured closed at its free and (41).

5. A package for a strip-shaped or band-shaped product made of plastic, paper or plastic foam, in roll form, an opening being provided in one of the package walls for removing the product, wherein the package (100) comprises a cubicle or a right parallelepipedal package body (10) made of cardboard with a hollow cylindrical holding device made of paperboard or cardboard, placed in the inner space (19) of the package body (10) and on two opposite side walls (13, 14) of the package body (10), for receiving the product roll (20), whereby the hollow cylindrical holding device (30) is held by means of two stoppers (40, 40') having a hollow cylindrical stopper body (41) and being stuck through circular openings or dowel holes (60) in the opposing side walls (13; 14) of the package body (10) constituting the pivot bearings for the hollow cylindrical holding device (30) and that both pivot bearing stoppers (40; 40') can be locked on the side walls (13; 14) of the package body (10), wherein the distance between the locking pins or trunnions (50, 50') and the ring-shaped disk or collar (42) of the stopper body (41) of each pivot bearing stopper (40; 40') approximately corresponds to the material thickness of the package body (10).

6. A package for a strip-shaped or band-shaped product made of plastic, paper or plastic foam, in roll form, an opening being provided in one of the package walls for removing the product, wherein the package (100) comprises a cubicle or a right parallelepipedal package body (10) made of cardboard with a hollow cylindrical holding device made of paperboard or cardboard, placed in the inner space (19) of the package body (10) and on two opposite side walls (13, 14) of the package body (10), for receiving the product roll (20), whereby the hollow cylindrical holding device (30) is held by means of two stoppers (40, 40') having a hollow cylindrical profile body (41) and being stuck through openings or dowel holes (60) in the opposing side walls (13; 14) of the package body (10) constituting the pivot bearings for the hollow cylindrical holding device (30) and that both pivot bearing stoppers (40; 40') can be locked on the side walls (13; 14) of the package body (10), wherein the stopper body (41) of each pivot bearing stopper (40; 40') has a ring-shaped disk (42) and a self-adhesive foil stuck onto an outer wall side of the ring-shaped disk (42) from outside which self-adhesive foil projects over the outer edge of the ring-shaped disc or collar (42) and which is stuck on the outer wall surface of the side wall (12; 13) of the package body (10) which receives the pivot bearing stopper (40; 40').

* * * * *